US006078000A

United States Patent [19]

Chen

[11] Patent Number: 6,078,000

[45] Date of Patent: Jun. 20, 2000

[54] STRUCTURE OF A MAGNET COUPLED TYPE WHITE GLASS BALL TRANSMISSION

[76] Inventor: Ju-Hung Chen, P.O. Box 82-144, Taipei, Taiwan

[21] Appl. No.: 09/165,107

[22] Filed: Oct. 2, 1998

[51] Int. Cl.[7] ..... G10F 3/00

[52] U.S. Cl. ..... 84/107; 84/94.1; 84/128

[58] Field of Search ..... 84/107, 94.1, 94.2, 84/95.1, 95.2, 106, 110, 113, 114, 128

[56] References Cited

U.S. PATENT DOCUMENTS

| | | | |
|---|---|---|---|
| 5,510,570 | 4/1996 | Liu | 84/95.2 |
| 5,665,926 | 9/1997 | Chen | 84/95.2 |
| 5,696,332 | 12/1997 | Yang | 84/95.2 |
| 5,705,759 | 1/1998 | DeVivo | 84/95.2 |

*Primary Examiner*—Robert E. Nappi
*Assistant Examiner*—Kim Lockett
*Attorney, Agent, or Firm*—A& J

[57] ABSTRACT

An improved structure of a magnet coupled type white glass ball transmission, more particularly an improved music white glass ball structure, being a breakthrough in the prior art that can generate only a single transmission and has a turning axle going into the white glass ball, which may lead to water leakage and requires use of an anti-leakage ferrule. By utilizing magnet coupled type white glass ball transmission, a rotor inside the glass ball can cause a propeller to rotate without making a through hole, so that swirls can be generated in the glass ball to drive floating particles or tinsels therein, thus creating a very beautiful scene. The power generated by the magnetic field drives a speed reduction gear set which transmit it to a turning disk at a reduced speed so that an ornament on the turning disk can turn round and round. Hence, a double transmission structure without making a through hole in the glass ball can be achieved.

1 Claim, 6 Drawing Sheets

STRUCTURE OF A MAGNET COUPLED TYPE WHITE GLASS BALL TRANSMISSION

BACKGROUND OF THE INVENTION

1. Field of the Invention

The present invention relates generally to a music white glass ball, and more particularly to a music white glass ball having an improved structure of a magnet coupled type white glass ball transmission.

2. Description of the Prior Art

Music boxes and white glass balls are popular ornaments and make good gifts. In recent years, there have been developed a combination structure of the music box and the white glass ball. A conventional combination structure as such is shown in FIG. 1 and comprises a mechanical music movement A1, a turning shaft A2, and a white glass ball A3 containing water. The music movement A1 drives the turning shaft A2, which extends into the white glass ball A3. In this structure, an ornament on the turning shaft A2 can rotate on its axis for displaying purposes. At the same time, by means of sound generating steel plate of the music movement A1, music is generated with the turning of the white glass ball A3. A critical problem with such a conventional structure is the extension of the turning shaft A2 into the white glass ball. The means of achieving this in the prior art is that an anti-leakage ferrule A4 is fitted between the turning axle A2 and a turning shaft hole to prevent leakage of water from the white glass ball. However, the employment of such a structure often results in poor product quality and other disadvantages including:

1. As the mechanical music movement A1 is expensive, the labor cost of making a music white glass ball is quite high, thus affecting competitiveness.
2. As the prior art utilizes the anti-leakage ferrule A4 to stop the space between the turning axle A2 and the turning axle hole, if the stopping force is not adequate, then leakage will result, which will cause corrosion of the mechanical music movement A1.
3. If, on the other hand, the stopping force is excessive, then the anti-leakage ferrule A4 will be a heavy burden to the turning of the mechanical music movement A1, so that the drive power is inadequate. Worse still, the turning axle may even be stopped from rotation so that the ornament thereon cannot rotate, which means that the music cannot be generated.
4. Furthermore, as the prime power source for the combination music white glass ball is a unitary one. Once the power is supplied to rotate the ornament, no power is left to supply to other peripheral items. It is therefore difficult to add peripheral functions to the music white glass ball, such as the provision of floating objects in the white glass ball.

SUMMARY OF THE INVENTION

This invention is related to an improved structure of a magnet coupled type white glass ball transmission, more particularly an improved music white glass ball structure, being a breakthrough in the prior art that can generate only a single transmission and has a turning axle going into the white glass ball, which may lead to water leakage and requires use of an anti-leakage ferrule. By utilizing magnet coupled type white glass ball transmission, a rotor inside the glass ball can cause a propeller to rotate without making a through hole, so that swirls can be generated in the glass ball to drive floating particles or tinsels therein, thus creating a very beautiful scene. The power generated by the magnetic field drives a speed reduction gear set which transmit it to a turning disk at a reduced speed so that an ornament on the turning disk can turn round and round. Hence, a double transmission structure without making a through hole in the glass ball can be achieved.

A primary object of the present invention is to provide an improved structure of a magnet coupled type white glass ball transmission to eliminate the drawbacks with the prior art.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
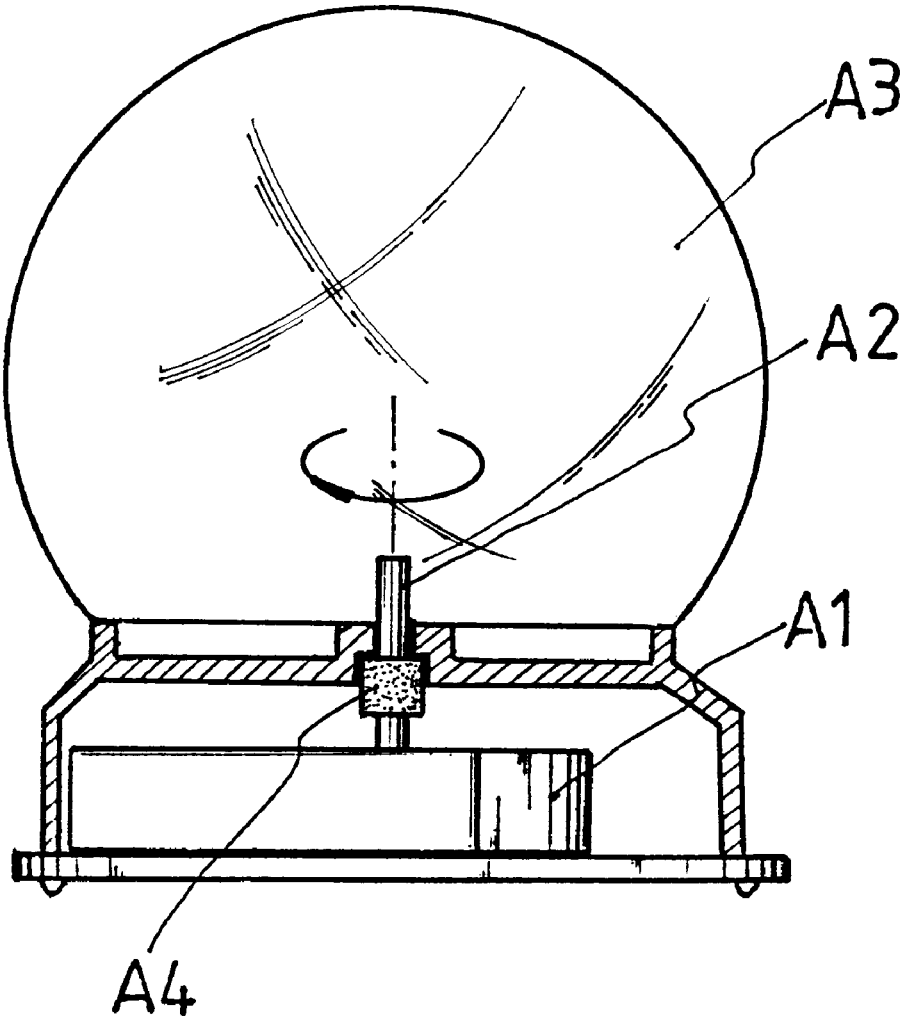
FIG. 1 is an assembled sectional schematic view of the prior art.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
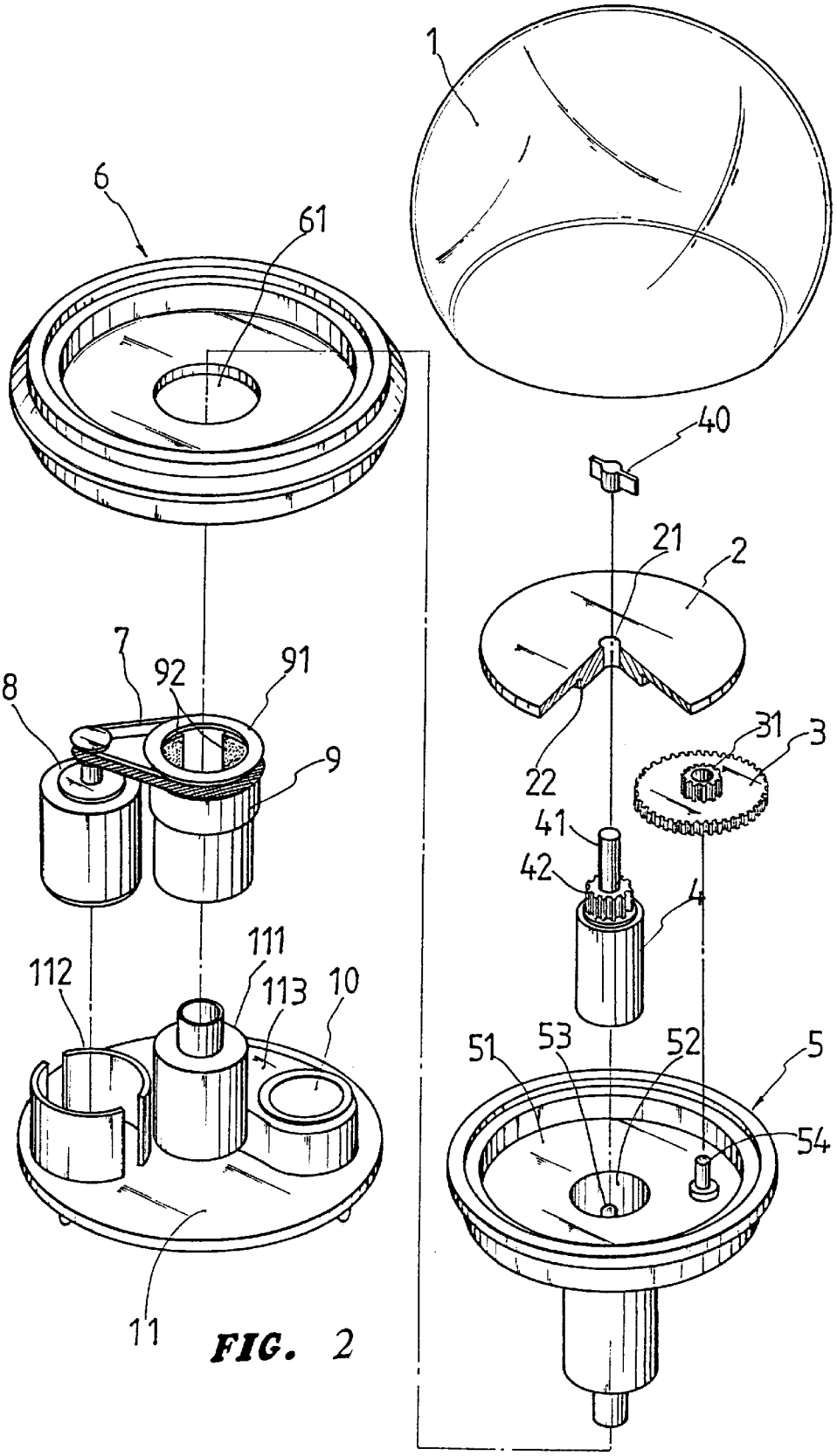
FIG. 2 is an exploded schematic view of a preferred embodiment of the present invention.
Figure 3:
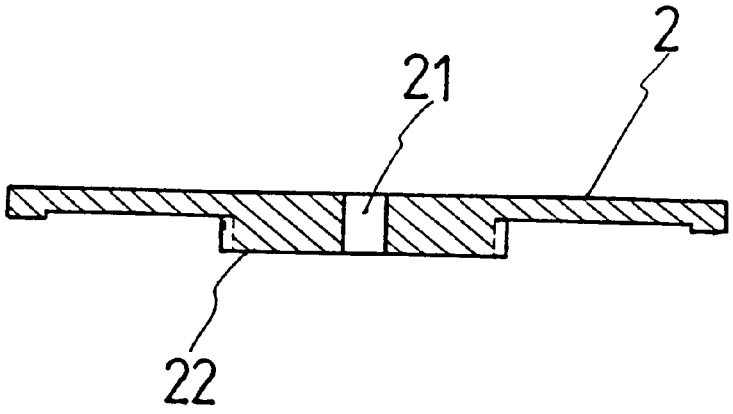
FIG. 3 is a sectional schematic view of a turning disk according to the present invention.
Figure 7:
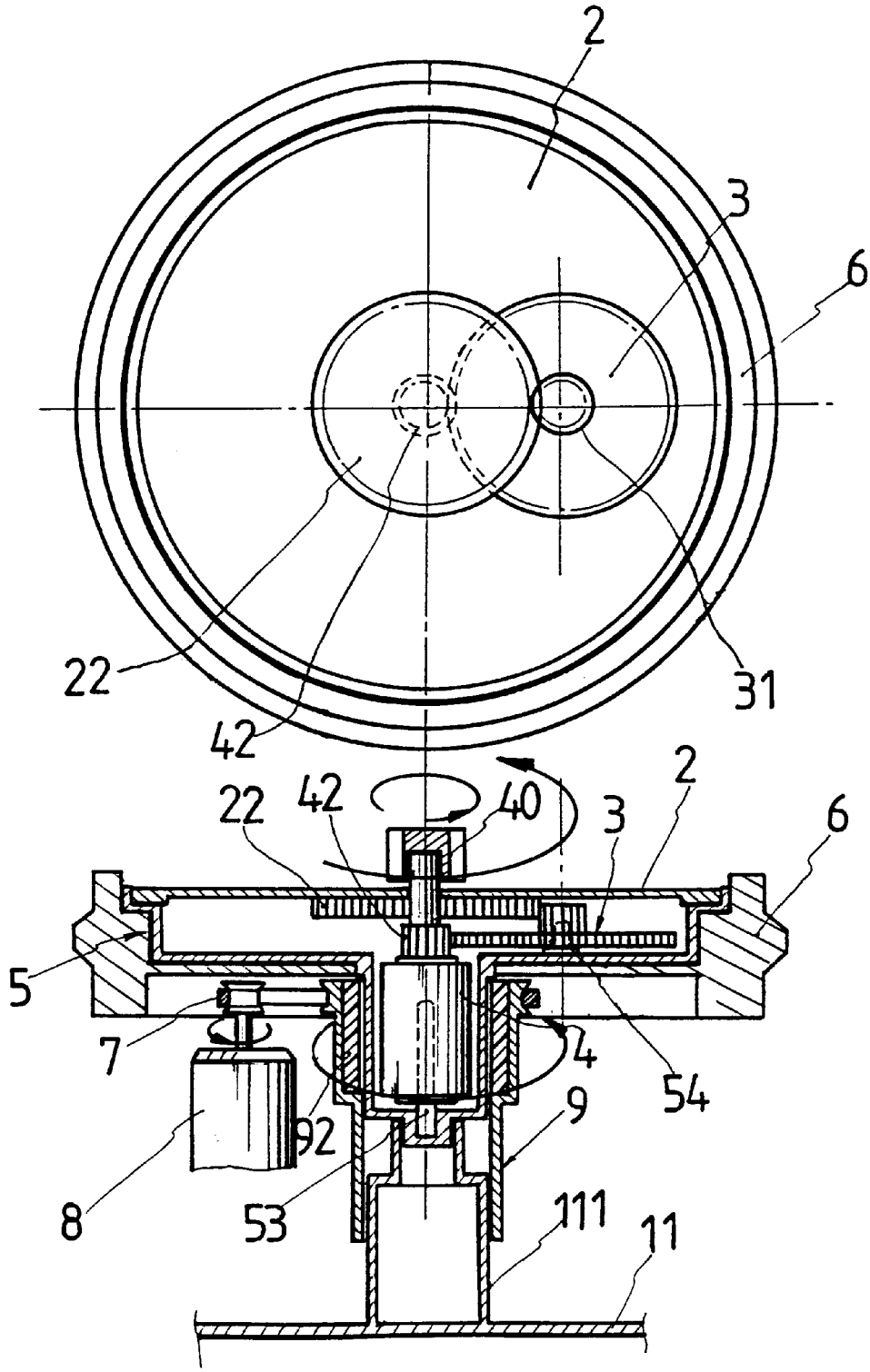
FIG. 7 is an assembled sectional schematic view showing engagement of gears according to the present invention.

With reference to FIG. 2, the structure of the present invention essentially comprises a transparent white glass ball 1, a turning disk 2, a speed reduction gear set 3, a rotor 4, a glass ball base plate 5, a waterproof plastic fitting seat 6, a drive belt 7, a motor 8, a drive magnetic ring sleeve 9, a music integrated circuit (IC) 10, and a base 11. The white glass ball 1 is insertably connected to the glass ball base plate 5 in tight fit. The white glass ball 1 contains a liquid that is mixed with a plurality of floating particles, tinsels, etc. The rotor 4, speed reduction gear set 3, turning disk 2, a propeller 40, and an ornament (not shown but fixedly secured to the turning disk 2) are fitted between the white glass ball 1 and the glass ball base plate 5 in sequence. As shown in FIG. 3, the turning disk 2 is disposed in a plate recess 51 of the glass ball base plate 5 and has the ornament fixedly disposed on a top side thereof. The turning disk 2 has a central through hole 21 for passage of an axle 41 of the rotor 4. The axle 41 is connected to the propeller 40, as shown in FIG. 7. In addition, a bottom side of the turning disk 2 is integrally formed to have a disk gear 22 that can engage a small gear 31 of the speed reduction gear set 3 so that the turning disk 2 can turn on its own axis.

Figure 4:
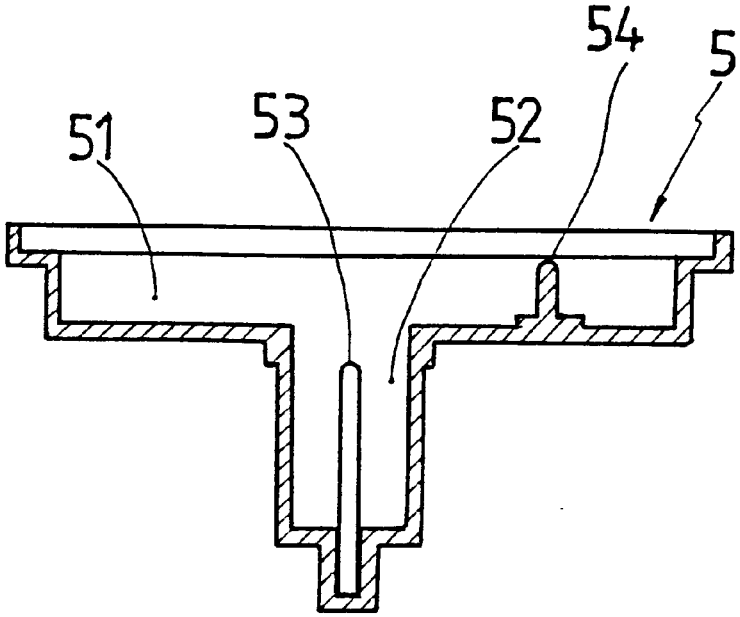
FIG. 4 is a sectional schematic view of a glass ball base plate according to the present invention.

With reference to FIG. 4, the glass ball base plate 5 includes the above-mentioned plate recess 51 and a bottom depression 52. The rotor 4 is disposed in the bottom depression 52 that has a spindle 53 projecting upwardly and inserted into the rotor 4 so that the latter can be positioned during rotation. The plate recess 51, on the other hand, has a pivot pin 54 projecting from the upper side thereof for pivotally mounting the speed reduction gear set 3, whereby the small gear 31 engages a rotor gear 42 at a front end of the rotor 4 to transmit the power to the turning disk 2, as shown in FIG. 7.

Referring back to FIG. 2, aside from being a magnetic body, the rotor 4 is integrally formed with the above mentioned rotor gear 42 at its front end, with the axle 41 extending from a front end of the rotor gear 42 and passing through the turning disk 2 to connect to and thereby drive the propeller 40. In addition, the rotor gear 42 at the front end of the rotor 4 engages the speed reduction gear set 3, and through the transmission by means of the speed reduction gear set 3, the turning disk 2 can be rotated to enable the turning disk 2 to turn on its own axis. In other words, when the rotor 4 rotates at a high speed, through the transmission and speed reduction by the speed reduction gear set 4, the rotational speed of the turning disk 2 can be slowed down to achieve the object of directional transmission at different speeds.

Figure 5:
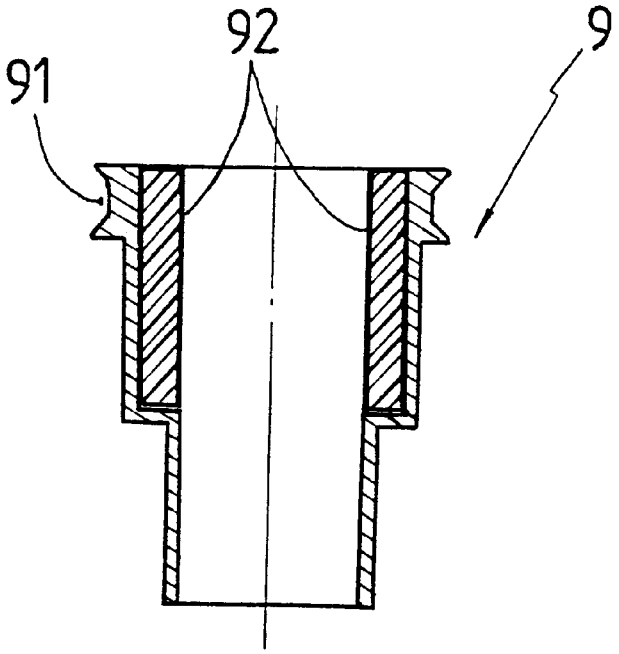
FIG. 5 is a sectional schematic view of a drive magnetic ring sleeve according to the present invention.
Figure 6:
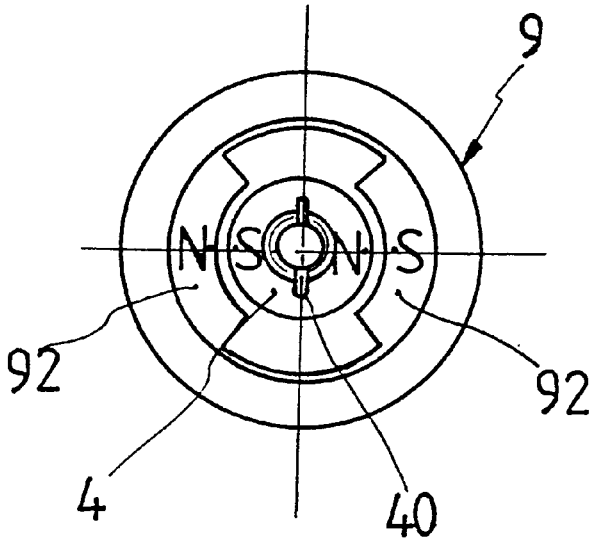
FIG. 6 is a top schematic view illustrating the relationship between the drive magnetic ring sleeve and a rotor.
Figure 8:
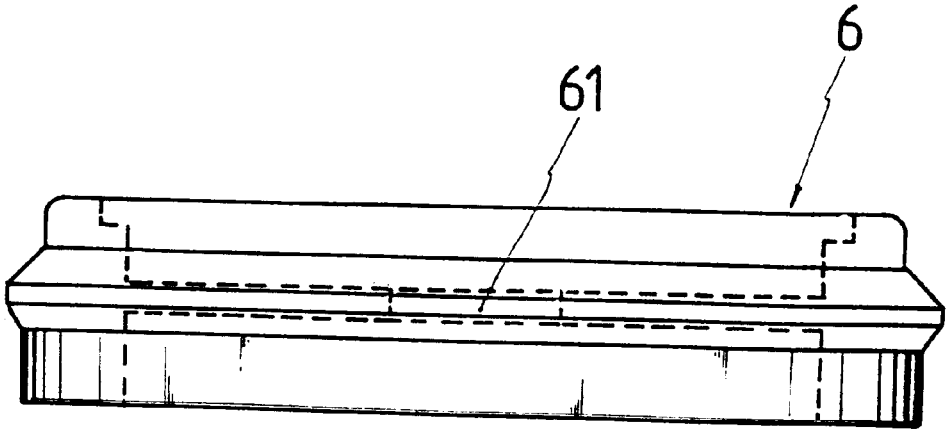
FIG. 8 is a plan perspective view of a waterproof plastic fitting seat according to the present invention.
Figure 9:
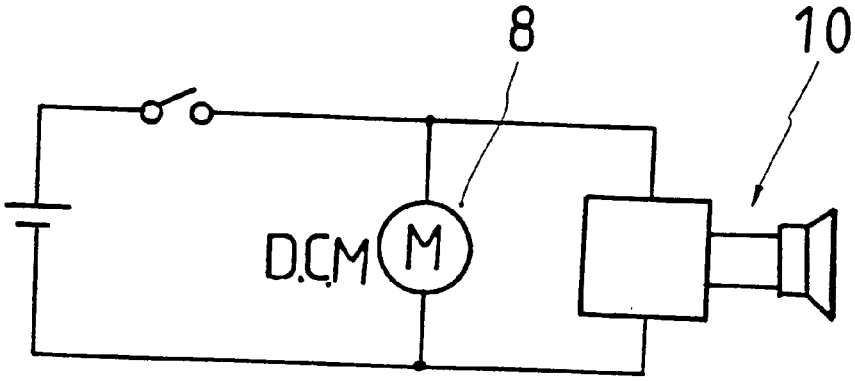
FIG. 9 is a schematic view of the circuitry according to the present invention.

Referring to FIG. 8, the waterproof plastic fitting seat 6 is provided to secure the glass ball base plate 5. The fitting seat 6 is centrally provided with a through hole 61. The bottom depression 52 passes through the through hole 61 of the fitting seat 6 to just fit into the drive magnetic ring sleeve 9 to generate a magnetic field effect. As shown in FIG. 5, the drive magnetic ring sleeve 9 has a wheel 91 having a concave or sunken peripheral portion at a top rim thereof. The motor 8 drives the wheel 91 via the drive belt 7. The magnetic ring sleeve 9 further includes two drive magnetic blocks 92 that can generate a magnetic field effect with the rotor 4, as shown in FIG. 6. Referring back to FIG. 2, the drive magnetic sleeve 9 is fitted onto a magnetic ring support 111 on a top side of the base 11 whereby it can be positioned during rotation. Additionally, the base 11 is provided with a motor mounting frame 112 in which the motor 8 is housed. The motor mounting frame 112 is spaced apart from the magnetic ring support 111, and the belt 7 is wound round the motor 8 and the wheel 91 of the magnetic ring sleeve 9. The base 11 further includes a battery casing 113 and the music IC 10. Referring to FIG. 7, when the power is on, the motor 8 drives the magnetic ring sleeve 9 via the drive belt 7. At the same time, the music IC 10 is started to play music. The magnetic field effect generated between the magnetic ring sleeve 9 and the rotor 5 causes the rotor 4 to rotate, which drives the propeller 40 and, through the speed reduction gear set 3, drives the turning disk 2 at a reduced speed, so that the ornament on the turning disk 2 can turn round and round. At the same time, the swirls generated within the white glass ball 1 drive the floating particles or tinsels, creating a very beautiful scene. The music IC 10 is connected to the motor 8 and can be actuated to play music during rotation of the motor 8 through the control of a switch (not shown).

In view of the aforesaid, it can be appreciated that the present invention provides a novel combination of the music box and the white glass ball, which is simple in construction and eliminates the problems with the prior art.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. An improved structure of a magnet coupled type white glass ball transmission, comprising a transparent white glass ball, a turning disk, a rotor, a speed reduction gear set, a glass ball base plate, a waterproof plastic fitting seat, a drive belt, a motor, a drive magnetic ring sleeve, a music integrated circuit, and a base, wherein said white glass ball is inserted into said glass ball base plate in tight fit and contains a liquid mixed with floating particles or tinsels or the like;

said turning disk is disposed on said glass ball base plate and has an ornament fixedly disposed thereon, said turning disk further having a central through hole, and a disk gear integrally formed at a bottom portion thereof;

said rotor is a magnetic body having a rotor gear integrally formed at a front end thereof that can engage said speed reduction gear set, with an axle projecting from a front end of said rotor gear, said axle passing through said central through hole of said turning disk to connect to and thereby drive a propeller;

said speed reduction gear set is pivotally mounted on a pivot pin provided on said plate recess of said glass ball base plate and has a small gear, said speed reduction gear set engaging said rotor gear and said disk gear to transmit the power generated by said rotor to said turning disk at a reduced speed so as to enable said turning disk to turn on its own axis, said small gear engaging said disk gear;

said glass ball base plate has a plate recess and a bottom depression, said turning disk being disposed in said plate recess, said plate recess having a pivot pin thereon to pivotally mount said speed reduction gear set, said rotor being disposed in said bottom depression, said bottom depression having a spindle projecting therefrom to extend into said rotor;

said waterproof plastic fitting seat is provided to secure said glass ball base plate thereon, and is centrally provided with a through hole for passage of said bottom depression of said glass ball base plate such that said bottom depression can just fit into said drive magnetic ring sleeve below to generate a magnetic field effect;

said drive magnetic ring sleeve has a wheel at a top end thereof, said wheel having a concave or sunken peripheral portion and being turned by said motor via said drive belt, said drive magnetic ring sleeve further having two drive magnetic blocks that can generate a magnetic field effect with said rotor; and said base having a magnetic ring support, a motor mounting frame, a battery casing, and said music integrated circuit provided thereon, said magnetic ring support receiving said drive magnetic ring sleeve for positioning said drive magnetic ring sleeve during rotation thereof, said motor mounting frame housing said motor such that said motor is spaced apart from said drive magnetic ring sleeve, with said drive belt wound round said motor and said wheel of said drive magnetic ring sleeve.

* * * * *